US006216672B1

(12) United States Patent
Mishima et al.

(10) Patent No.: US 6,216,672 B1
(45) Date of Patent: Apr. 17, 2001

(54) FUEL SUPPLY SYSTEM OF OUTBOARD MOTOR

(75) Inventors: Shuichi Mishima, Iwata; Jun Ito, Hamamatsu, both of (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/340,037

(22) Filed: Jun. 28, 1999

(30) Foreign Application Priority Data

Jun. 29, 1998 (JP) ..... 10-182619

(51) Int. Cl.[7] ..... F02M 41/00
(52) U.S. Cl. ..... 123/516; 123/509
(58) Field of Search ..... 123/516, 518, 123/519, 509, 510, 497

(56) References Cited

U.S. PATENT DOCUMENTS 5,103,793 * 4/1992 Riese et al. ..... 123/516
5,389,245 * 2/1995 Jaeger et al. ..... 123/516
5,647,331 * 7/1997 Swanson ..... 123/516
5,819,711 * 10/1998 Motose ..... 123/516
5,855,197 * 1/1999 Kato ..... 123/516
5,865,160 * 2/1999 Kato ..... 123/516
5,873,347 * 2/1999 Kato et al. ..... 123/497
5,915,363 * 6/1999 Iwata et al. ..... 123/516

* cited by examiner

*Primary Examiner*—Carl S. Miller
(74) *Attorney, Agent, or Firm*—Oblon, Spivak, McClelland, Maier & Neustadt, P.C.

(57) ABSTRACT

An outboard motor of fuel injection type includes a fuel supply system which comprises a fuel tank in which a fuel is stored, a low pressure fuel filter and a low pressure fuel pump connected to the fuel tank through a fuel supply hose, a vapor separator connected to the low pressure fuel pump through a low pressure fuel hose, a high pressure fuel pump disposed inside the vapor separator, a pressure regulator disposed inside the vapor separator, a fuel hose having one end connected to the high pressure fuel pump, a branch pipe incorporated on the way of the fuel hose and having one end connected to the pressure regulator, and a delivery pipe connected to another one end of the branch pipe. A fuel injector is connected to the delivery pipe and adapted to inject the fuel with pressure regulated by the pressure regulator.

12 Claims, 3 Drawing Sheets

24H:HIGH PRESSURE FUEL FILTER
24L:LOW PRESSURE FUEL FILTER
25H:HIGH PRESSURE FUEL PUMP
25L:LOW PRESSURE FUEL PUMP
27:PRESSURE REGULATOR
29:INJECTOR
31:FUEL TANK
40:FLOAT

FUEL SUPPLY SYSTEM OF OUTBOARD MOTOR

BACKGROUND OF THE INVENTION

The present invention relates to a fuel supply system of an outboard motor.

In a known art, an outboard motor is provided with a fuel supply system or apparatus for fuel injection type engine, and such fuel supply system is operated in a manner that a fuel in a fuel tank is guided to a vapor separator by means of a low pressure fuel pump, then delivered to a high pressure fuel filter by means of a high pressure fuel pump and filtered therein, and thereafter, is guided to an intake port by a fuel injector through a delivery pipe. An extra amount of the fuel fed to the fuel injector is delivered to a pressure regulator from a downstream side of the delivery pipe and is thereafter returned to the vapor separator after a fuel pressure has been lowered.

In the conventional structure, however, since the vapor separator and the pressure regulator are arranged apart from each other around an engine. Accordingly, a space around the engine is not effectively utilized and, in addition, duct or pipe arrangement is made complicated.

Furthermore, in the conventional structure, fuel elements or members constituting the fuel supply system such as a vapor separator, a pressure regulator, a fuel pump, a fuel filter, etc. are arranged or mounted to various portions of the engine, thus being inconvenient for performing maintenance or inspection of the engine and making it difficult to realize a compact structure of the engine.

SUMMARY OF THE INVENTION

An object of the present invention is to substantially eliminate defects or drawbacks encountered in the prior art mentioned above and to provide a fuel supply system of an outboard motor having a compact structure and having an improved arrangement of fuel elements to easily carry out maintenance work.

This and other objects can be achieved according to the present invention by providing a fuel supply system of an outboard motor, particularly of a fuel-injection type, comprising:

- a fuel tank in which a fuel to be supplied is stored;
- a low pressure fuel filter and a low pressure fuel pump connected to the fuel tank through a fuel supply hose;
- a vapor separator connected to the low pressure fuel pump through a low pressure fuel hose;
- a high pressure fuel pump disposed inside the vapor separator;
- a pressure regulator disposed inside the vapor separator;
- a fuel hose having one end connected to the high pressure fuel pump;
- a branch pipe incorporated on the way of the fuel hose means and having one end connected to the pressure regulator through a hose; and
- a delivery pipe connected to another one end of the branch pipe.

In a preferred embodiment, a plurality of fuel injectors are connected to the delivery pipe and adapted to inject the fuel with pressure regulated by the pressure regulator.

The respective elements or parts mentioned above are integrally mounted to a mount base such as intake manifolds of an outboard motor.

A high pressure fuel filter is further disposed on the way of the fuel hose operatively connecting the high pressure fuel pump and the delivery pipe.

The vapor separator has an inner space sectioned by a partition plate into upper and lower portions in which the high pressure fuel filter and the pressure regulator are arranged respectively.

According to the structure of the fuel supply system of an outboard motor mentioned above, the fuel supply system can be made more unitive and the number of parts or elements to be arranged can be reduced, thus making the entire structure simple and compact.

The fuel elements or parts constituting the fuel supply system are mounted integrally to the intake manifold as mount base. Therefore, all the elements or parts of the fuel supply system can be integrally dismounted by removing the low pressure fuel hose from the low pressure fuel pump. As a result, the maintenance of the engine can be effectively performed and the fuel supply system itself can be made more unitive. Furthermore, re-assembling of such fuel supply system can be also done more simply.

The location of the high pressure fuel filter between the vapor separator and the delivery pipe can prevent foreign matters or the like from entering into the fuel injectors, thus the system being reliable.

Still furthermore, according to the present invention, since the fuel discharge port as the high pressure fuel outlet is formed to, for example, the upper portion of the vapor separator and the pressure regulator as the high pressure fuel inlet is located to, for example, the lower portion of the vapor separator, the overlapped arrangement of the fuel hoses can be prevented, thereby making the pipe (piping) arrangement compact.

The nature and further characteristic features of the present invention will be made more clear from the following description made with reference to the accompanying drawings.

DESCRIPTION OF THE PREFERRED EMBODIMENT

One preferred embodiment of the present invention will be described hereunder with reference to the accompanying drawings.

Figure 1:
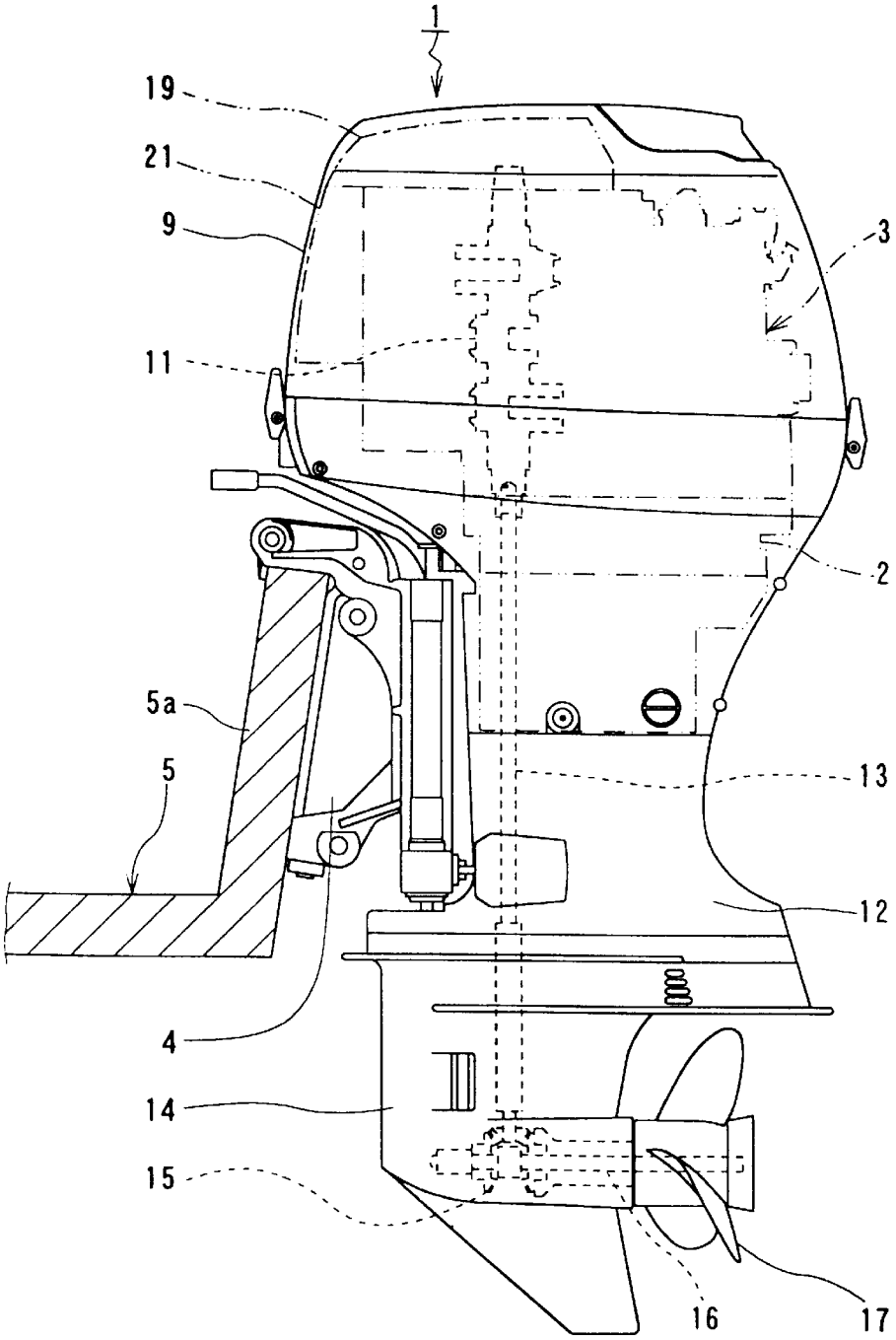
FIG. 1 is a left-side view of an outboard motor having a fuel supply system according to one embodiment of the present invention in a state mounted to a hull.

First, FIG. 1, shows an outboard motor 1 equipped with a fuel supply system or apparatus according to the present invention in a state mounted to a transom 5*a* of a hull 5.

The outboard motor 1 is provided with an engine holder 2 above which an engine or engine unit 3 is disposed. The engine holder 2 is provided with a bracket 4 through which the outboard motor 1 is mounted to the transom 5*a* of the hull 5.

Figure 2:
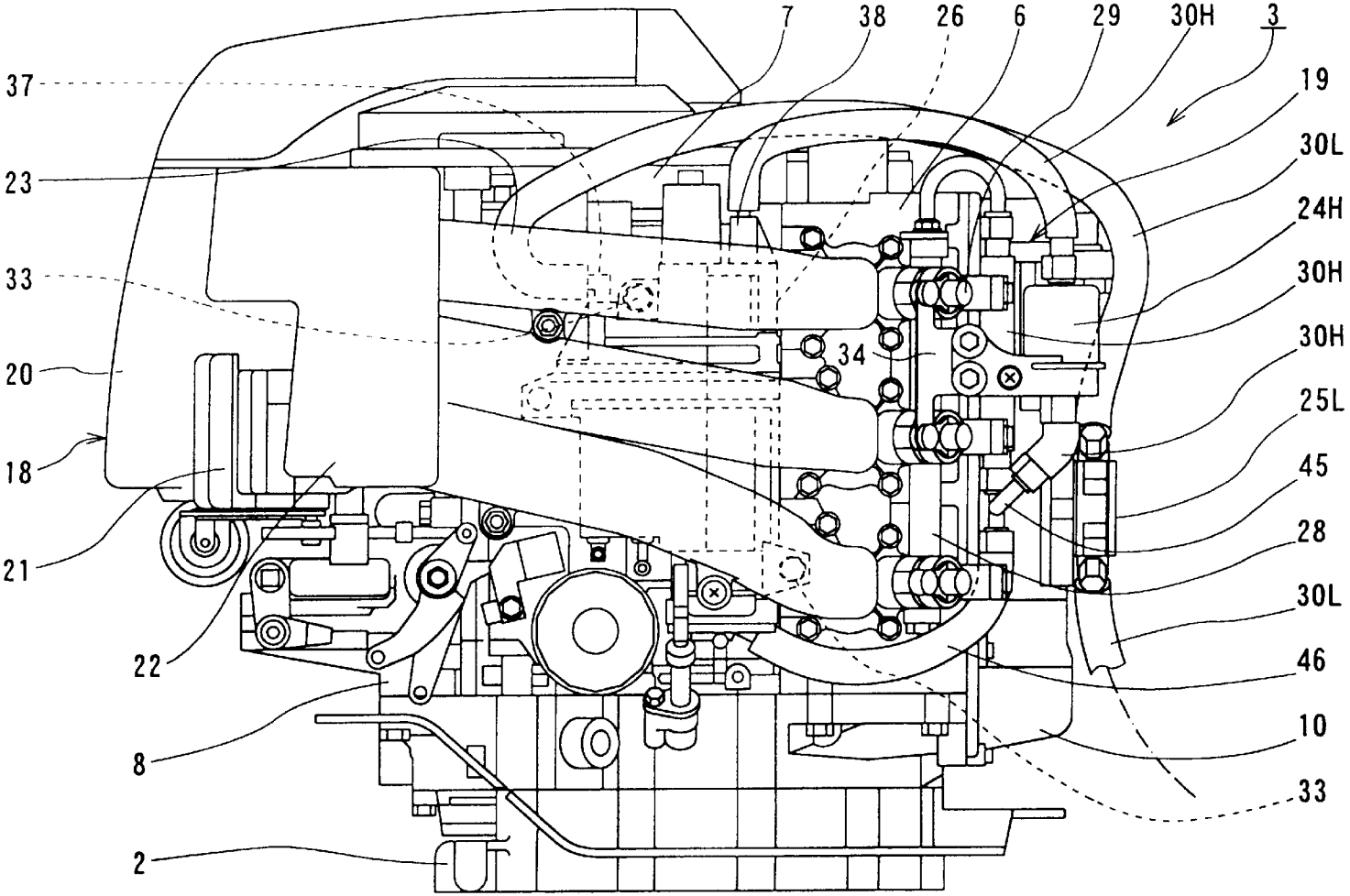
FIG. 2 is a side view, in an enlarged scale, of an engine of the outboard motor of FIG. 1.

Next, FIG. 2, shows the engine 3 of the outboard motor, the engine unit 3 mounted to the outboard motor 1 is, for example, a water-cooled four-stroke-cycle three-cylinder engine, and is assembled with a cylinder head 6, a cylinder block 7, crank case 8, etc. The outer periphery of the engine 3 is covered by an outboard motor cover 9.

The cylinder block 7 is arranged to a portion at a rear side of the crank case 8 disposed at the most forward portion, left-side as viewed in FIG. 2, of the engine 3, and the cylinder head 6 is disposed at the rear portion of the cylinder block 7. The rear side portion of the cylinder head 6 is covered by a head cover 10, and a crank shaft 11 is arranged substantially vertically at a mating portion of the crank case 8 and the cylinder block 7 (FIG. 1).

Referring to FIG. 1, a drive shaft housing 12 is disposed below the engine 3. An upper end of a drive shaft 13 is coupled to the lower end of the crank shaft 11 through a spline coupling, for example, and the drive shaft 13 extends downward therefrom inside the drive shaft housing 12. The lower end of the drive shaft 13 is engaged with a bevel gear 15 and a propeller shaft arranged in a gear case 14 disposed below the drive shaft housing 12 thereby to drive a propeller 17 of the outboard motor 1.

As shown in FIG. 2, there are arranged, around the engine 3, electrical equipments, not shown, an intake device 18, a fuel supply system or apparatus 19, etc. The intake device is mainly composed of a silencer 20, a throttle body 21, a surge tank 22 and intake manifolds 23 extending from the surge tank 22 to respective cylinders, these elements being arranged concentrically on one side, left side in this embodiment, of the engine 3. The electrical equipments are also arranged concentrically on the side opposite to the intake device 18.

The throttle body 21 composing the intake device 18 is disposed at a left front portion, for example, of the crank case 8, and the silencer 20 is disposed on the upstream side of the throttle body 21 and, on the other hand, the surge tank 22 is disposed on the downstream side thereof. The intake manifolds 23 are vertically arranged on the side of the cylinder block 7 so as to communicate the inside of the surge tank 22 with intake ports formed to the cylinder head 6.

The fuel supply system 19 includes fuel elements or parts such as filters, pumps, etc. More concretely, the fuel supply system 19 is composed of low and high pressure filters 24L and 24H, low and high pressure fuel pumps 25L and 25H, a vapor separator 26, a pressure regulator 27, a delivery pipe 28 and a fuel injector 29, which are operatively connected respectively by means of low and high pressure fuel hoses 30L and 30H.

Figure 3:
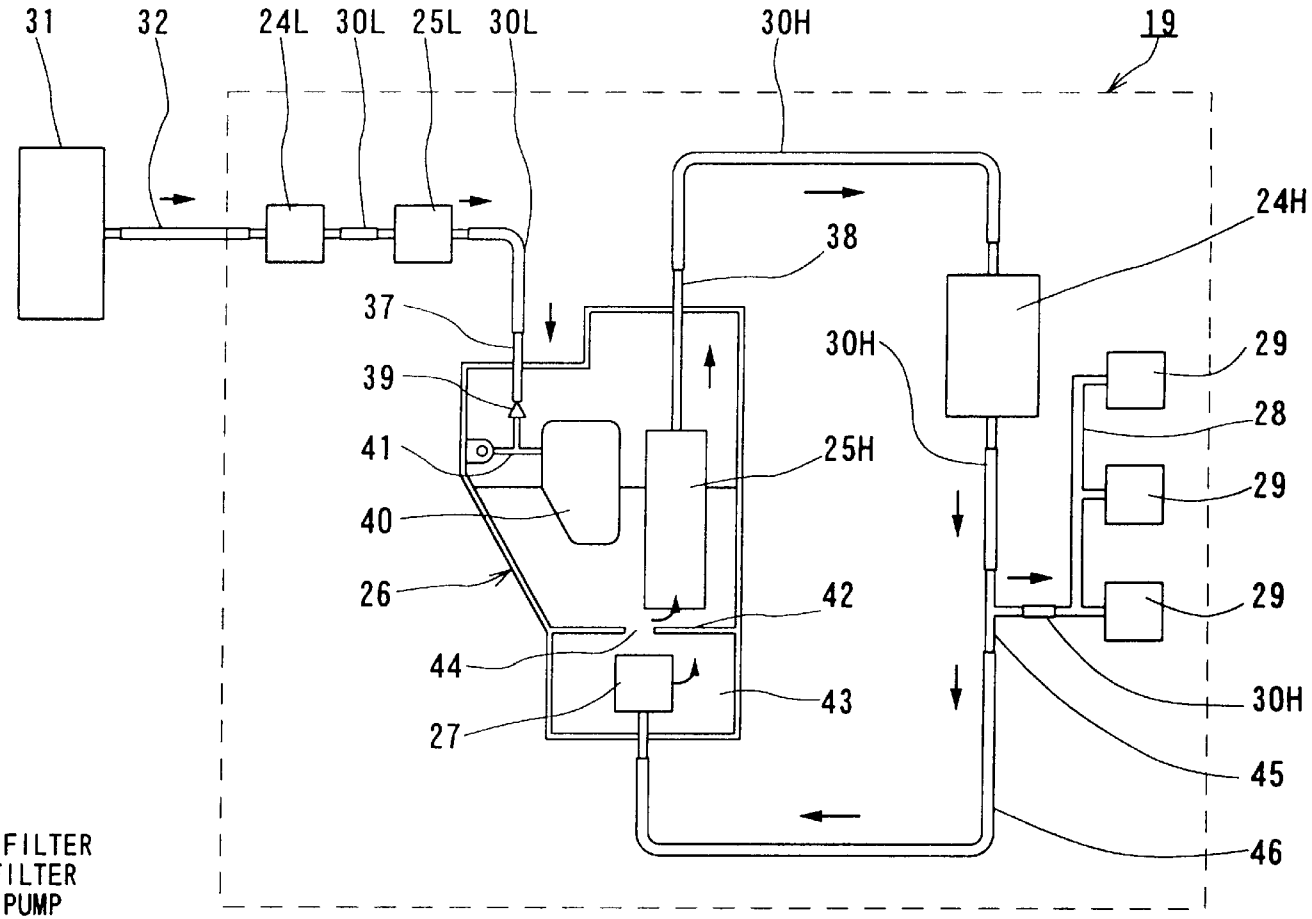
FIG. 3 is a block diagram of the fuel supply system of the outboard motor of FIG. 1.

FIG. 3 is a block diagram of the fuel supply system 19 according to the present invention. The outboard motor 1 of this embodiment is equipped with a fuel tank 31 on the hull 5 side, and as shown in FIG. 3, a fuel supply hose 32 extending from the fuel tank 31 is connected to the low pressure fuel filter 24L.

The low pressure fuel pump 25L driven by a camshaft, not shown, constituting a valve moving mechanism of the engine, is arranged to the head cover 10, and the low pressure fuel pump 25L (mechanical pump) and the low pressure fuel filter 24L are connected to each other by means of the low pressure fuel hose 30L.

The vapor separator 26 is arranged in a space formed between the side surface of the cylinder block 7 and the intake manifolds 23, and the vapor separator 26 is secured to an inside portion of the intake manifolds 23 as a mount base by means of bolts 33, for example. The vapor separator 26 acts to separate a vapor contained in a liquid fuel, such as gasoline vapor contained in a gasoline and release only the vapor in air, and the fuel is fed to the vapor separator 26 from the low pressure fuel pump 25L through the low pressure fuel hose 30L.

The vapor separator 26 is accommodated with the high pressure fuel pump 25H for feeding, under a predetermined pressure, the fuel from which the vapor is separated, to the high pressure fuel filter 24H through the high pressure hose 30H. The high pressure fuel filter 24H is secured to the delivery pipe 28 through a bracket 34 disposed to a portion, for example, between a plurality of fuel injectors 29.

The highly pressurized fuel fed to the high pressure fuel filter 24H is then fed to the delivery pipe 28 integrally mounted to the intake manifolds 23 through the high pressure hose 30H. The fuel injectors 29 are mounted to the delivery pipe 28 for the respective cylinders and the fuel injectors 29 then inject the highly pressurized fuel into the intake ports of the cylinders.

A fuel flow-in portion 37 is arranged to an upper portion of an inner surface of the vapor separator 26 and a needle valve 39 is disposed at an outlet portion of the fuel flow-in portion 37. A float 40 is also disposed at a portion near this outlet portion of the fuel flow-in portion 37. The float 40 is supported to be swingable by means of hinge 41, for example, to which the needle valve 39 is mounted.

The high pressure fuel pump 25H is mounted to an upstream side of a fuel discharge portion 38 arranged to the upper portion inside the vapor separator 26. The inside of the vapor separator 26 is formed as a fuel reservoir in which the high pressure fuel pump 25H is immersed. A chamber 43 is formed at a lower portion of the fuel reservoir by being sectioned by a partition plate 42. The pressure regulator 27 as inlet means of the high pressure fuel is arranged in this chamber 43. The partition plate 42 is formed with a communication port 44 for establishing the communication between the fuel reservoir and the chamber 43.

As shown in FIGS. 2 and 3, a branch pipe 45 is disposed on the way of the high pressure fuel hose 30 extending from the high pressure fuel filter 24H to the delivery pipe 28, and one downstream end of the branch pipe 45 is connected to the high pressure fuel hose 30H extending to the delivery pipe 28 and another one end of the branch pipe 45 is connected to a hose 46 extending to the vapor separator 26, the hose 46 being then connected to the pressure regulator 27 in the vapor separator 26.

The fuel supply system of the structure mentioned above will operates in the following manner.

The fuel in the fuel tank 31 is sucked up by the low pressure fuel pump 25L, then filtered by the low pressure fuel filter 24L and guided to the vapor separator 26 through the fuel flow-in portion 37. When the fuel level in the vapor separator 26 reaches a predetermined level, the float 40 is floated up and the needle valve 39 closes the outlet of the fuel flow-in portion 37 thereby to restrict the fuel flow-in condition, thus preventing the fuel from overflowing. On the other hand, when the fuel level lowers as the fuel has been consumed, the float 40 is also lowered thereby to release the outlet of the fuel flow-in portion to again supply the fuel.

In the vapor separator 26, vapor from the fuel stored therein is separated and bubbles of the vapor are released in the air (atmosphere), and the fuel with substantially no vapor is supplied to the delivery pipe 28 by means of the high pressure fuel pump 25H through the fuel discharge outlet 38 and the high pressure fuel filter 24H. Thereafter, the highly pressurized fuel is injected into the intake ports through the fuel injectors 29. During this operation, as far as the fuel injection has been normally carried out, the fuel pressure in the hose 46 extending from the branch pipe 45 is less than the prescribed pressure, so that the pressure regulator 27 is not opened.

On the contrary, at a time when the fuel pressure in the delivery pipe 28 is increased more than the prescribed value because of, for example, the reduced fuel consumption due to low revolution speed of the engine 3, the fuel pressure in the hose 46 is also increased. Accordingly, the pressure regulator 27 is opened and the fuel pressure in the delivery pipe 28 is lowered.

As mentioned above, according to the arrangement of the pressure regulator 27 in the vapor separator 26, the fuel supply system can be made more unitive and the number of parts or elements to be arranged can be reduced, thus making the entire structure simple and compact.

The fuel elements or parts constituting the fuel supply system 19 such as the high pressure filter 24H, the high pressure fuel pump 25H, the vapor separator 26, the pressure regulator 27, the delivery pipe 28 and the fuel injectors 29 are mounted integrally to the intake manifold means 23 as mount base. Therefore, all the elements or parts of the fuel supply system 19 can be integrally dismounted by removing the low pressure fuel hose 30 from the low pressure fuel pump 25L. As a result, the maintenance of the engine can be effectively performed and the fuel supply system 19 itself can be made more unitive. Furthermore, re-assembling of such fuel supply system can be also done more simply.

Still furthermore, the location of the high pressure fuel filter 24H between the vapor separator 26 and the delivery pipe 28 can prevent foreign matters or the like from entering into the fuel injectors 29, thus the system being reliable.

Still furthermore, according to the present invention, since the fuel discharge port 38 as the high pressure fuel outlet is formed to, for example, the upper portion of the vapor separator 26 and the pressure regulator 27 as the high pressure fuel inlet is located to, for example, the lower portion of the vapor separator 26, the overlapped arrangement of the fuel hoses 30H can be prevented, thereby making the pipe (piping) arrangement compact.

It is to be noted that the present invention is not limited to the described embodiment and many other changes and modifications may be made without departing from the scopes of the appended claims.

What is claimed is:

1. A fuel supply system of an outboard motor having an engine holder, an engine disposed above the engine holder in a state installed to a hull and including a cylinder block, and an intake device disposed on a side of the engine with a space therefrom and including an intake manifold, said fuel supply system comprising:

a fuel tank in which a fuel to be supplied is stored;

a low pressure fuel filter and a low pressure fuel pump connected to the fuel tank through a fuel supply hose;

a vapor separator connected to the low pressure fuel pump through a low pressure fuel hose and disposed in the space between the cylinder block and the intake device;

a high pressure fuel pump disposed inside the vapor separator;

a pressure regulator disposed inside the vapor separator;

a fuel hose having one end connected to the high pressure fuel pump;

a branch pipe interposed a the fuel hose and having a first end connected to the pressure regulator through a hose; and a delivery pipe connected to a second end of the branch pipe.

2. A fuel supply system according to claim 1, further comprising a fuel injector connected to the delivery pipe and adapted to inject the fuel with pressure regulated by the pressure regulator.

3. A fuel supply system according to claim 1, wherein said vapor separator is integrally mounted to a mount base of the outboard motor.

4. A fuel supply system according to claim 3, wherein said mount base is the intake manifold.

5. A fuel supply system according to claim 1, further comprising a high pressure fuel filter interposed along the fuel hose operatively connecting the high pressure fuel pump and the delivery pipe.

6. A fuel supply system according to claim 1, wherein said vapor separator has an inner space sectioned by a partition plate into upper and lower portions in which the high pressure fuel pump and the pressure regulator are arranged respectively, said upper and lower portions being communicated through a port formed to the partition plate.

7. A fuel supply system of an outboard motor having an engine holder, an engine and an intake device, the engine including a cylinder block and disposed above the engine holder in the outboard motor installed on a hull, the intake device including an intake manifold and disposed on a side of the engine, said fuel supply system comprising:

a fuel tank;

a low pressure fuel filter and a low pressure fuel pump connected to the fuel tank through a fuel supply hose;

a vapor separator connected to the low pressure fuel pump through a low pressure fuel hose and disposed in a space between the cylinder block and the intake device;

a high pressure fuel pump disposed inside the vapor separator;

a pressure regulator disposed inside the vapor separator;

a fuel hose having one end connected to the high pressure fuel pump;

a branch pipe interposed along the fuel hose and having a first end connected to the pressure regulator through a hose; and a delivery pipe connected to a second end of the branch pipe.

8. A fuel supply system according to claim 7, further comprising a fuel injector connected to the delivery pipe and configured to inject the fuel with pressure regulated by the pressure regulator.

9. A fuel supply system according to claim 7, wherein said vapor separator is integrally mounted to a mount base of the outboard motor.

10. A fuel supply system according to claim 7, wherein said vapor separator is integrally mounted to the intake manifold.

11. A fuel supply system according to claim 7, further comprising a high pressure fuel filter interposed along the fuel hose connecting the high pressure fuel pump and the delivery pipe.

12. A fuel supply system according to claim 7, wherein:

said vapor separator comprises a partition plate and a communication port in the partition plate;

said partition plate divides an inner space of said vapor separator into an upper portion and a lower portion which are communicated through the communication port; and the high pressure fuel pump is disposed in the upper portion and the pressure regulator is disposed in the lower portion.

* * * * *